US005181682A

United States Patent [19]

Indelicato

[11] Patent Number: 5,181,682

[45] Date of Patent: Jan. 26, 1993

[54] TOOL HOLDER

[75] Inventor: Joseph A. Indelicato, Bellingham, Mass.

[73] Assignees: Luanne Kiley; John R. Newman, both of Bellingham, Mass. ; part interest to each

[21] Appl. No.: 699,364

[22] Filed: May 13, 1991

[51] Int. Cl.[5] ..... E06C 7/00

[52] U.S. Cl. ..... 248/210; 248/231.9

[58] Field of Search ..... 248/210, 211, 238, 231.9, 248/231.2, 231.8, 231.3, 315, 216.1, 71; 182/129, 120; 403/297; 24/696, 682, 458

[56] References Cited

U.S. PATENT DOCUMENTS

| | | | |
|---|---|---|---|
| 2,912,205 | 11/1959 | Toune | 248/315 X |
| 4,077,595 | 3/1978 | Carter et al. | 248/210 |
| 4,099,693 | 7/1978 | Blann . | |
| 4,145,840 | 3/1979 | Davidson | 248/231.2 X |
| 4,186,903 | 2/1980 | Fazakerley | 248/210 |
| 4,445,659 | 5/1984 | LaChance . | |
| 4,662,594 | 5/1987 | Dubis | 248/231.2 X |
| 4,702,446 | 10/1987 | Brown | 248/210 |
| 4,824,060 | 4/1989 | Korda | 248/210 |

*Primary Examiner*—Karen J. Chotkowski
*Attorney, Agent, or Firm*—Kriegsman & Kriegsman

[57] ABSTRACT

A device for holding an elongated hand tool of a tradesman in close proximity to his area of work while he is working on an extension ladder having a plurality of hollow rungs. The device comprises a generally U-shaped mounting member having a base and a pair of outwardly-biasing, concave-shaped legs. The device also comprises a generally cylindrical section of piping which is adapted to hold an elongated hand tool. The section of piping and the base are preferably spaced apart by a spacer, which is curved at one end to lie flush against the side of the section of piping and is flat at the other end to lie flush against the base. The section of piping, the spacer, and the base are interconnected by an externally threaded bolt, which is secured in place by a lock washer and a nut. To mount the device in a hollow rung, the user squeezes together the outwardly biasing legs and inserts them into the hollow rung. Next, the user releases the legs, causing them to expand outwardly and to press against the inside walls of the hollow rung. This pressure serves to prevent device from being inadvertently pulled out of the rung.

2 Claims, 1 Drawing Sheet

TOOL HOLDER

BACKGROUND OF THE INVENTION

The present invention relates generally to tool holders and more particularly to tool holders which are adapted to be mounted within a rung of a hollow rung type ladder.

In U.S. Pat. No. 4,702,466, there is disclosed a ladder caddy for connecting a pail of paint, stain or other such substance to a ladder having hollow rungs and utilizing the hollow portion of one of the rungs to position the pail out to the side of the ladder. The ladder caddy comprises a holding arm that enters a hollow rung from either side of the ladder and equipped with two short rubber friction sleeves that surround the holding arm at each extreme end of its exposed surface, a support arm into which is anchored at its top end and at 90 degrees one end of the holding arm, and to which on its opposite side is anchored a backboard, the bottom edge of which is flush with the bottom end of the support arm, a pail holding band support which is flat on one side is anchored horizontally to, and across, the midsection of the backboard with the opposite side having a concave portion cut out to a depth of about one-half inch to match the contour of the pail, a narrow sheet metal pail holding band anchored in the concave area of the holding band support and equipped with a cam type lock for compressing the band around the pail and with tool hooks anchored to its outer side, a support rod having two parallel ends and a v-shaped horizontal base, with the parallel ends mounted between the backboard and the pail holding band support upon which horizontal portion the pail rests when placed within the pail holding band, and a sheet metal paint brush retainer, one edge of which is pressure-anchored between the backboard and holding band support and the opposite side bent in the shape of an inverted "v" thus providing additional holding pressure against the side of the brush.

In U.S. Pat. No. 4,523,733, there is disclosed an attachment for connecting a container of liquid to one side of a ladder having tubular metal rungs. The attachment includes a rigid member of a length and cross-sectional dimensions providing an anchor portion to be freely inserted in a selected end of a selected one of the ladder rungs and a support portion then to extend laterally of the ladder, and a container holder suspended from the support portion, said holder including a base and wall structure including opposite portions and rigidly connected thereto to said support portion with the center of gravity of the holder in vertical alignment with a plane inclusive of the mid points of said opposite portions and the center of said base also inclusive of the axis of said support portion whereby when a container with liquid therein is connected to the ladder by the insertion of the anchor portion in the selected rung, said anchor portion is held in frictional engagement with the rung and said plane is vertical.

In U.S. Pat. No. 4,445,659, there is disclosed a combination bracket and adjustable ladder tray for holding the tools and materials of a tradesman in close proximity to his area of work while he is working on an extension ladder. The device of this invention includes a tray contoured to fit the most commonly used tools and materials of the tradesman, apparatus for securing these tools in said tray and a support bracket which on one side is adjustably secured to the base of said tray and on the other side has provision for secure attachment within the hollow rungs of an extension ladder. The tray is adjustable so that it can be always level relative to the ground or in any other angular position, regardless of the angle at which the ladder is placed against a structure.

In U.S. Pat. No. 4,186,903, there is disclosed a painter's fixture for a hollow ladder. The fixture comprises a base member and insert section at one end of said base member movable between a first expandable open position and a second contractable closed position, compressing against the inner surface of said hollow ladder rung to retain the fixture in place. Means are provided to detachably attach a paint brush having a hole in the handle thereof to the base member.

In U.S. Pat. No. 4,099,693, there is disclosed a support for use in conjunction with hollow rung ladders. The support has an elongated portion adapted to pass through the hollow rungs with a retaining configuration on the end thereof. The opposite end has a container bail engaging projection with a container side support positioned therebelow.

SUMMARY OF THE INVENTION

It is an object of the present invention to provide a new and improved device for holding the hand tools of a tradesman in close proximity to his area of work while he is working on an extension ladder having hollow rungs.

It is another object of the present invention to provide a device as described above which is adapted to hold various types of elongated hand tools, such as a caulking gun, a hammer, a square, a pry bar, and the like.

It is still another object of the present invention to provide a device as described above which is compact and has a minimal number of parts.

In accordance with the foregoing objects, a device for holding an elongated hand tool of a tradesman in close proximity to his area of work while he is working on an extension ladder having a plurality of hollow rungs comprises a generally U-shaped mounting member for insertion into one of the hollow rungs, the generally U-shaped mounting member shaped to define a base portion and a pair of legs, said pair of legs being outwardly biasing to engage the inside walls of the hollow rung, and means mounted to said base portion for holding the elongated hand tool.

In a preferred embodiment, said holding means comprises a section of piping which is sized appropriately to hold elongated hand tools, such as caulking guns, hammers, squares, pry bars, and the like, with the elongated portion of the hand tool resting inside the piping and the transverse portion of the hand tool hanging over the top of the piping.

One advantage associated with the device of the present invention is that it can easily be mounted within and removed from a hollow rung of a ladder, without requiring the use of any mounting tools, screws, brackets or other hardware.

Another advantage associated with the device of the present invention is that it stays securely within the ladder rung, even when the ladder is moved.

Additional objects, features, and advantages of the present invention will be set forth in part in the description which follows, and in part will be obvious from the description which or may be learned by practice of the invention. The objects of the invention also may be realized and attained by means of the instrumentalities and combinations particularly pointed out in the appended claims.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
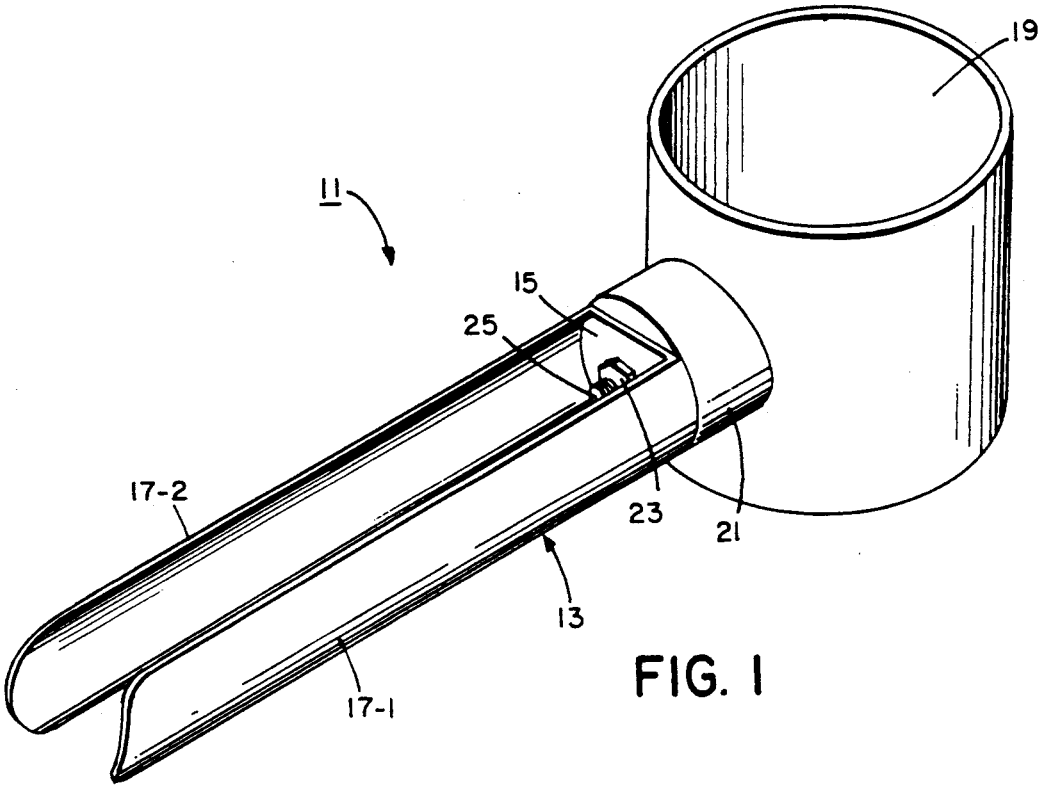
FIG. 1 is a perspective view of one embodiment of a tool holding device adapted to be mounted within the rung of a hollow rung type ladder, the device being constructed according to the teachings of the present invention.

Referring now to the drawings and in particular to FIG. 1, there is shown one embodiment of a device for holding an elongated hand tool of a tradesman in close proximity to his area of work while he is working on an extension ladder having a plurality of hollow rungs, the device being constructed according to the teachings of the present invention and represented generally by reference numeral 11.

Device 11 comprises a mounting member 13. Mounting member 13, which is preferably a unitary structure, is a generally U-shaped element having a base 15 and a pair of legs 17-1 and 17-2. As will be discussed below in greater detail, legs 17-1 and 17-2 are made to be outwardly biasing so that when they are inserted into one of the hollow rungs of a hollow rung type ladder, they will press firmly against the inside walls of the rung in such a way as to prevent device 11 from being inadvertently pulled out of the rung. Also to ensure that device 11 is mounted securely within the rung, legs 17 are preferably concave in shape to increase the amount of surface area in contact with the inside walls of the rung.

Member 13 may be made of a light gauge steel, a spring steel, or similar material. Exemplary dimensions for base 15 are about 0.75 inch by about 0.5–0.75 inch and for legs 17 are about 12 inches by about 0.5–0.75 inch.

Device 11 also comprises means for holding and elongated hand tool. In the embodiment shown, said holding means comprises a section of piping 19, which is generally cylindrical in shape. Piping 19 is preferably a unitary structure made of polyvinyl chloride or similar material. Exemplary dimensions for piping 19 are about 2.75–3 inches in diameter by about 4 inches in height.

Piping 19 may be mounted directly on base 15, or, as is the case with the embodiment shown, piping 19 and base 15 may be spaced apart by a spacer 21. Spacer 21, which is preferably made of hard rubber, plastic or similar material, is curved at one end to lie flush against the side of piping 19 and is flat at the other end to lie flush against base 15.

Piping 19, spacer 21, and base 15 are interconnected by an externally threaded bolt 23, which is secured in place by a lock washer (not shown) and a nut 25.

Figure 2:
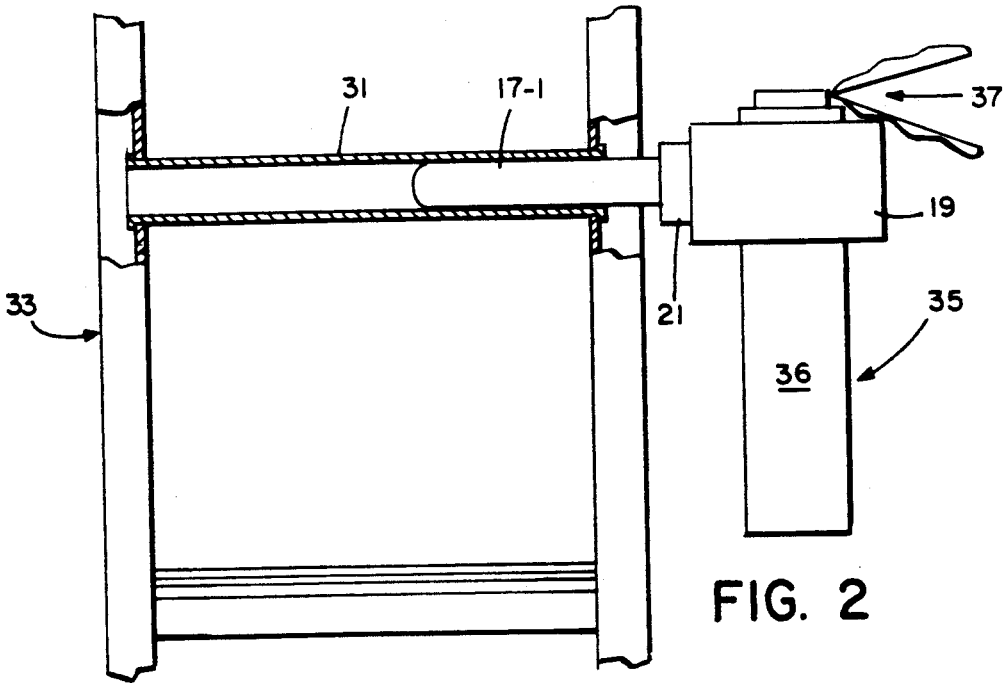
FIG. 2 is a plan view of a hollow rung type ladder, the ladder being broken away in part to reveal a tool holding device of the type shown in FIG. 1 mounted in one its hollow rungs, the device being shown holding a chaulking gun.

Referring now to FIG. 2, device 11 is shown mounted within a hollow rung 31 of a hollow rung type ladder 33, device 11 being used to hold an elongated hand tool, such as a caulking gun 35.

To mount device 11 in hollow rung 31, the user squeezes together legs 17-1 and 17-2 and inserts them into hollow rung 31. Next, the user releases legs 17-1 and 17-2, causing the legs to expand outwardly and to press against the inside walls of hollow rung 31. Such pressure exerted by legs 17-1 and 17-2 against the inside walls of hollow rung 31 serves to prevent device 11 from being inadvertently pulled from rung 31.

As can readily be appreciated, device 11 can be mounted on ladder 33 from either the right side or the left side of hollow rung 31 to facilitate use by either righthanded or lefthanded tradesmen.

To remove device 11 from hollow rung 31, the user squeezes together legs 17-1 and 17-2 and pulls them out of rung 31.

To use device 11 to hold an elongated hand tool, such as caulking gun 35, the user places the elongated portion 36 of caulking gun 35 through piping 19 and rests the transverse portion 37 (i.e., the trigger) over the top of piping 19.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for holding an elongated hand tool of a tradesman in close proximity to his area of work while he is working on an extension ladder having a plurality of hollow rungs comprising:

a) a cylindrical section of piping adapted to hold an elongated hand tool;

b) a generally U-shaped mounting member adapted for insertion into one of the hollow rungs, said generally U-shaped mounting member being shaped to define a base portion and a pair of generally parallel legs, said pair of legs being concave in shape and being outwardly biased to press against the inside walls of the hollow rung, said base portion being disposed between said pair of generally parallel legs; and c) means for mounting said cylindrical section of piping on said base portion of said generally U-shaped mounting member.

2. The device as claimed in claim 1 wherein each of said base portion of said generally U-shaped mounting member and said cylindrical section of piping has a hole formed therein, each of said holes being adapted to receive a bolt therethrough and wherein said mounting means comprises a spacer disposed between said base portion and said cylindrical section of piping and a bolt, said bolt being inserted through said base portion, said spacer, and said cylindrical section of piping.

* * * * *